United States Patent [19]

Hartline, III et al.

[11] 4,043,839

[45] Aug. 23, 1977

[54] INTERNAL NITRIDATION OF COBALT-BASE SUPERALLOYS

[75] Inventors: Albert G. Hartline, III; Lynn E. Kindlimann, both of Woodland Hills, Calif.

[73] Assignee: Allegheny Ludlum Industries, Inc., Pittsburgh, Pa.

[21] Appl. No.: 689,402

[22] Filed: May 24, 1976

Related U.S. Application Data

[63] Continuation-in-part of Ser. No. 565,189, April 3, 1975, abandoned.

[51] Int. Cl.[2] ..... C21D 1/56

[52] U.S. Cl. ..... 148/20.3; 148/16.6; 75/171

[58] Field of Search ..... 148/20.3, 16.6, 38; 75/170, 171

[56] References Cited

U.S. PATENT DOCUMENTS

| | | | |
|---|---|---|---|
| 3,432,294 | 3/1969 | Wheaton | 75/171 |
| 3,642,546 | 2/1972 | Van Thyne et al. | 148/20.3 |
| 3,804,678 | 4/1974 | Kindlimann | 148/38 |

*Primary Examiner*—Walter R. Satterfield

*Attorney, Agent, or Firm*—Vincent G. Gioia; Robert F. Dropkin

[57] ABSTRACT

A method of internally nitriding and thereby strengthening cobalt-base superalloys having at least 33% cobalt, up to 0.15% carbon, no more than 25% nickel and from 1 to 3% of nitride forming elements from the group consisting of titanium, vanadium, niobium, tantalum and zirconium. The method comprises the steps of: heating the cobalt-base alloy at a temperature of from 1600° to 2500° F in a nitrogen-bearing atmosphere substantially free of moisture and oxygen, and diffusing nitrogen from said atmosphere into and throughout said alloy for a period of time sufficient to form nitrides having an interparticle spacing of less than 10 microns.

13 Claims, No Drawings

INTERNAL NITRIDATION OF COBALT-BASE SUPERALLOYS

This application is a continuation-in-part of now abandoned copending application Ser. No. 565,189, filed Apr. 3, 1975.

The present invention relates to a process for enhancing the high temperature properties of cobalt-base superalloys.

U.S. Pat. No. 3,650,729 (Mar. 21, 1972) U.S. Pat. No. 3,663,312 (May 16, 1972) and U.S. Pat. No. 3,804,678 (Apr. 16, 1974) describe processes for improving the high temperature properties of stainless steel. Specifically, the processes described therein call for the internal nitridation of stainless steel under conditions which generate nitride particles having a free energy of formation of greater than −21,000 cal./mole and a small interparticle spacing.

The teachings of said cited patents might at first glance appear beneficial for other alloy groups; and, if so, one of these groups could be cobalt-base superalloys, known for their outstanding high temperature properties. However, on considered thought, the nitridation of cobalt-base superalloys is not at all obvious. Cobalt-base superalloys are know to have inherently lower solubility for nitrogen than that of stainless steel.

Despite their lower nitrogen solubilities, the present invention provides a process for internally nitriding cobalt-base superalloys. By maintaining nickel levels below 25% and carbon levels below 0.15%; and through controlled processing described hereinbelow, cobalt-base superalloys have been successfully internally nitrided.

On Mar. 13, 1973, a U.S. patent describing the nitridation of cobalt-base superalloys issued. The patent is U.S. Pat. No. 3,720,551. Unlike the present invention, it relates to surface nitridation and not internal nitridation. In other words, it calls for a process of nitriding the surface of alloy powder which is subsequently hot consolidated to fragment the nitride film, and create an article with a dispersoid throughout. On the other hand, the present invention calls for a process where in the entire volume of the alloy is nitrided through diffusion.

It is accordingly an object of this invention to provide a chemical process for enhancing the high temperature properties of cobalt-base superalloys.

The present invention provides a chemical process for enhancing the high temperature properties of cobalt-base superalloys; and in particular cobalt-base alloys having no more than 25%, and preferably no more than 20% nickel. With higher nickel levels nitrogen diffusion is too severely impaired for the process to be successful. For purposes of definition, cobalt-base superalloys are those in which cobalt is both the major constituent, and an element present in amounts of at least 33%. Also present within said cobalt-base superalloys are chromium and from 1 to 3% of a nitride forming element, or elements, from the group consisting of titanium, vanadium, niobium, tantalum and zirconium. Titanium is the preferred nitride former. Other elements which enhance properties can also be part of the subject superalloys. Examples of these elements are molybdenum and boron. Carbon, a residual element, is kept at levels below 0.15% to discourage the formation of carbides; e.g., titanium carbide. A preferred maximum carbon content is 0.08%.

After nitridation, the cobalt-base superalloy has nitride particles from the group consisting of titanium nitride, vanadium nitride, niobium nitride, tantalum nitride and zirconium nitride, substantially distributed therethrough. The nitrides are present at an interparticle spacing of less than 10 microns, and preferably less than 2 microns. Interparticle spacings of less than 1 micron are particularly desirable. As a general rule, the nitrided cobalt-base superalloys produced by the subject invention are less than 25 mils thick, and preferably less than 10 mils thick. Of course, nitrided sheets and powders may be consolidated into thicker members.

Processing for the present invention, comprises the steps of: heating a cobalt-base alloy containing chromium, nickel in an amount of up to 25%, and from 1 to 3% of nitride forming elements from the group consisting of titanium, vanadium, niobium, tantalum and zirconium at a temperature of from 1600° to 2500° F, preferably 1800° to 2200° F, in a nitrogen-bearing atmosphere substantially devoid of moisture and oxygen; and diffusing nitrogen from said atmosphere into and throughout said alloy for a period of time sufficient to form nitrides of said elements. The precipitated nitrides have an interparticle spacing of less than 10 microns and are distributed substantially throughout the alloy.

As with all diffusion processes, nitriding is a time and temperature dependent process. Temperatures of at least 1600° F are employed as diffusion rates are too slow at lower temperatures. On the other hand, temperatures should not exceed 2500° F as less nitride particles are nucleated at higher temperatures. Temperatures of from 1800° to 2200° F are preferred as they balance the advantage of nucleating more nitride particles at lower temperatures with the accompanying disadvantage of slower nitriding times and increased growth of nitride particles. Times cannot be precisely set forth as they are dependent upon nitriding temperatures and upon the size of the alloy being nitrided. They can, however, be in excess of the period at which the material is exposed to the nitrogen-bearing atmosphere. For example, the nitrogen-bearing atmosphere could be removed with nitrogen diffusion only a fraction of the way through the alloy. Nitriding would then be completed by the dissolution of unstable and undesirable nitrides, such as chromium nitrides, which releases the nitrogen necessary to complete nitridation. This completion could occur at any temperature within the nitriding range and if desirable, could be performed simultaneously with the removal of excess nitrogen, an operation described hereinabelow. The unstable nitrides form during the early stages of nitridation when there is an over abundance of nitrogen.

The nitrogen-bearing atmosphere can be comprised of nitrogen, ammonia, mixtures of the two, and mixtures of them with other non-oxidizing gases. The term non-oxidizing gases as used herein refers to hydrogen or inert gases such as argon. Ammonia is the preferred atmosphere. The presence of moisture and/or oxygen severely affects the nitriding rate.

In order to avoid the formation of an excessive number of chromium nitrides at the grain boundaries, it is desirable, but not always necessary, to remove excess nitrogen; the amount over that necessary to react with the referred to nitride forming elements, and possibly elements such as molybdenum, tungsten and aluminum. Chromium nitride formation removes chromium from solid solution, thus reducing the materials' corrosion and oxidation resistance. Moreover, chromium nitrides embrittle the alloy. On the other hand, nitrides of elements such as molybdenum, tungsten and aluminum are often helpful, but not necessary. Removal of nitrogen can be effected by treating the alloy at an elevated temperature in a vacuum, or with a purging gas non-reactive with the alloy, e.g., hydrogen. Temperatures in excess of 1800° F are generally employed.

The following examples are illustrative of several embodiments of the invention.

EXAMPLE I

A sample (Sample A) of a cobalt-base alloy was nitrided at a temperature of 1900° F in ammonia substantially free of moisture and oxygen; and purged of excess nitrogen at a temperature of 2000° F in an atmosphere of dry hydrogen. The sample was 5.6 mils thick, and had the following nominal composition:

Cr — 25%
Ni — 15%
Ti — 2%
Mo — 6%
Fe — 1%
C — <0.08%
Co — 51%

The nitrided alloy was subsequently tested at 2000° F to determine its high temperature tensile properties. Another sample (Sample B) of the same cobalt-base alloy was similarly tested. This sample was not nitrided. Its thickness was 5.5 mils. The results of the tests appear hereinbelow in Table I.

TABLE I

| | Sample A | Sample B |
|---|---|---|
| 0.2% Yield Strength (ksi) | 18.0 | 3.35 |
| Ultimate Tensile Strength (ksi) | 27.0 | 7.60 |
| % Elongation in 1¼" | 1.6 | 11.9 |

From Table I it is clear that the nitrided sample (Sample A) is considerably stronger than the sample which was not nitrided. The nitrided sample had approximately 4 volume percent of titanium nitride.

EXAMPLE II

Two samples (Samples C and D) were nitrided under identical conditions. The nitriding atmosphere was ammonia substantially free of moisture and oxygen, and the nitriding temperature was 1900° F. Sample C had a cobalt plus nickel content of 66%, but only 15% nickel. Sample D, on the other hand, had a cobalt plus nickel content of only 59%, but a nickel content of 29%. Nickel contents in excess of 25% are outside the scope of the subject invention. Nitrogen diffusion is severly impaired by nickel.

A metallographic analysis of Samples C and D revealed that titanium nitride penetration was more than twice as deep in Sample C than in Sample D, despite the fact that Sample C had a higher cobalt plus nickel content than did Sample D. Sample D, however, had twice as much nickel as did Sample C; and as stated hereinabove nickel is an impediment to the diffusion of nitrogen. The composition of Samples C and D appears hereinbelow in Table II.

TABLE II

| | Sample C | Sample D |
|---|---|---|
| Cr | 25 | 30 |
| Ni | 15 | 29 |
| Ti | 2 | 2 |
| Mo | 6 | 6 |
| Fe | 1 | 2.7 |

TABLE II-continued

| | Sample C | Sample D |
|---|---|---|
| C | <0.08% | <0.08% |
| Co | 51 | 30 |

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. A method of strengthening cobalt-base superalloys by internal nitridation of substantially the entire volume of said alloys, which comprises the steps of: heating a cobalt-base alloy containing at least 33% cobalt as the major constituent, chromium, up to 25% nickel, up to 0.15% carbon, from 1 to 3% of nitride forming elements from the group consisting of titanium, vanadium, niobium, and tantalum, balance residuals and those elements which enhance the properties of cobalt-base alloys, at a temperature of from 1600° to 2500° F in a nitrogen-bearing atmosphere substantially free of moisture and oxygen, and diffusing nitrogen from said atmosphere into and throughout said alloy for a period of time sufficient to form nitrides having an interparticle spacing of less than 10 microns, said nitrides being from the group consisting of titanium nitride, vanadium nitride, niobium nitride and tantalum nitride, said nitrides being distributed substantially throughout said nitrided alloy; said cobalt base alloy being less than 25 mils thick.

2. A method according to claim 1, wherein said cobalt-base superally contains from 1 to 3% titanium.

3. A method according to claim 1, wherein said cobalt-base superalloy is heated at a temperature of from 1800° to 2200° F.

4. A method according to claim 1, including the additional step of treating said cobalt-base superalloy, to remove excess nitrogen.

5. A method according to claim 1, wherein nitrogen is diffused into said cobalt-base superalloy for a period of time sufficient to form nitrides having an interparticle spacing of less than 2 microns.

6. A method according to claim 1, wherein nitrogen is diffused into said cobalt-base superalloy for a period of time sufficient to form nitrides having an interparticle spacing of less than 1 micron.

7. A method according to claim 1, wherein said nitrogen-bearing atmosphere is from the group consisting of ammonia, nitrogen, and mixtures thereof with each and with other non-oxidizing gases.

8. A method of strengthening cobalt-base superalloys by internal nitridation of substantially the entire volume of said alloys, which comprises the steps of: heating a cobalt-base alloy containing at least 33% cobalt as the major constituent, chromium, up to 25% nickel, up to 0.15% carbon, from 1 to 3% of nitride forming elements from the group consisting of titanium, vanadium, niobium, tantalum and zirconium, balance residuals and those elements which enhance the properties of cobalt-base alloys, at a temperature of from 1600° to 2500° F in a nitrogen-bearing atmosphere substantially free of moisture and oxygen, and diffusing nitrogen from said atmosphere into and throughout said alloy for a period of time sufficient to form nitrides having an interparticle spacing of less than 10 microns, said nitrides being from the group consisting of titanium nitride, vanadium nitride, niobium nitride, tantalum nitride and zirconium nitride, said nitrides being distributed substantially throughout said nitrided alloy; said cobalt base alloy being less than 25 mils thick.

9. A method according to claim 8, wherein said cobalt-base superalloy is heated at a temperature of from 1800° to 2200° F.

10. A method according to claim 8, including the additional step of treating said cobalt-base superalloy, to remove excess nitrogen.

11. A method according to claim 8, wherein nitrogen is diffused into said cobalt-base superalloy for a period of time sufficient to form nitrides having an interparticle spacing of less than 2 microns.

12. A method according to claim 8, wherein nitrogen is diffused into said cobalt-base superalloy for a period of time sufficient to form nitrides having an interparticle spacing of less than 1 micron.

13. A method according to claim 8, wherein said nitrogen-bearing atmosphere is from the group consisting of ammonia, nitrogen, and mixtures thereof with each and with other non-oxidizing gases.

* * * * *